US005145486A

United States Patent [19]

Hannemann

[11] Patent Number: 5,145,486

[45] Date of Patent: Sep. 8, 1992

[54] PROCESS FOR DYEING WOOL WITH REACTIVE DYES

[75] Inventor: Klaus Hannemann, Lörrach, Fed. Rep. of Germany

[73] Assignee: Ciba-Geigy Corporation, Ardsley, N.Y.

[21] Appl. No.: 654,139

[22] Filed: Feb. 11, 1991

[30] Foreign Application Priority Data

Feb. 14, 1990 [CH] Switzerland ..... 477/90

[51] Int. Cl.[5] ..... C09B 62/00

[52] U.S. Cl. ..... 8/543; 8/588; 8/591; 8/604; 8/606; 8/609; 8/917; 252/8.75; 252/8.9

[58] Field of Search ..... 8/588, 543, 591, 606; 252/8.75

[56] References Cited

U.S. PATENT DOCUMENTS 3,919,283 11/1975 Berger et al. ..... 8/580
4,304,566 12/1981 van der Eltz et al. ..... 8/543
4,444,564 4/1984 Salathe et al. ..... 8/588

FOREIGN PATENT DOCUMENTS 2168364 6/1986 United Kingdom .

*Primary Examiner*—A. Lionel Clingman
*Attorney, Agent, or Firm*—Marla J. Mathias; Edward McC. Roberts

[57] ABSTRACT

There is disclosed a process for producing non-skittery and level dyeings on wool with reactive dyes in the presence of an auxiliary combination, which process comprises dyeing wool with an aqueous liquor consisting of at least one reactive dye and an auxiliary combination comprising, as component (a), at least one compound of formula

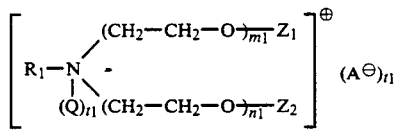

(1a)

and, as component (b), at least one compound of formula

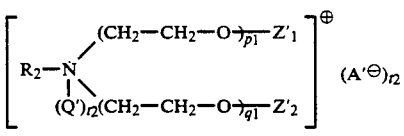

(1b)

wherein $R_1$ and $R_2$ are each independently of the other an aliphatic radical of 12 to 24 carbon atoms, Q and Q' are each independently of the other $C_1$-$C_4$alkyl, $—CH_2—CO—NH_2$,

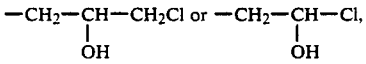

$A^{\ominus}$ and $A'^{\ominus}$ are an anion, $Z_1$, $Z_2$, $Z'_1$ and $Z'_2$ are each independently of one another hydrogen, $SO_3M$ or $PO_3M$, wherein M is hydrogen, alkali metal or ammonium, $t_1$ and $t_2$ are 1 or 0, when $t_1$ and $t_2$ are O, $Z_1$, $Z_2$, $Z'_1$ and $Z'_2$ are hydrogen or one of $Z_1$, $Z_2$, $Z'_1$ and $Z'_2$ is hydrogen and the other is $SO_3M$ or $PO_3M$, $m_1$, $n_1$, $p_1$ and $q_1$ are integers, the sum of $(m_1+n_1)$ being 2 to 15 and that of $(p_1+q_1)$ being 25 to 200, and finishing the dyeing, irrespective of the depth of shade, in the pH range from 4.0 to 5.0.

The dyeing process of this invention gives non-skittery and level dyeings, especially in light to medium shades of good light- and wetfastness properties.

16 Claims, No Drawings

PROCESS FOR DYEING WOOL WITH REACTIVE DYES

The present invention relates to a novel process for producing non-skittery and level dyeings on wool with reactive dyes, to the material dyed by said novel process, and to a formulation for carrying out said process.

In U.S. Pat. No. 4 444 564 it is taught to dye natural polyamide fibres in the fibre preserving pH range. However, it is only possible to produce dark shades satisfactorily for dyeing with reactive dyes by means of this process.

Surprisingly, a novel process has now been found which makes it possible to obtain non-skittery and level dyeings, in light to medium shades, on wool with reactive dyes in the fibre preserving pH range.

Specifically, the present invention relates to a process for producing non-skittery and level dyeings on wool with reactive dyes in the presence of an auxiliary combination, which process comprises dyeing wool with an aqueous liquor consisting of at least one reactive dye and an auxiliary combination comprising, as component (a), at least one compound of formula

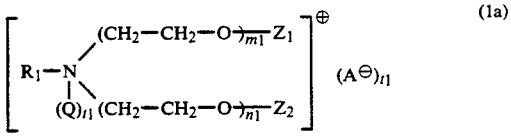

(1a)

and, as component (b), at least one compound of formula

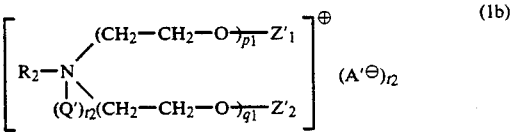

(1b)

wherein $R_1$ and $R_2$ are each independently of the other an aliphatic radical of 12 to 24 carbon atoms, Q and Q' are each independently of the other $C_1$-$C_4$alkyl, $—CH_2—CO—NH_2$,

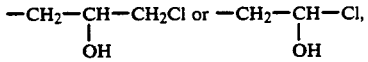

$A^{\ominus}$ and $A'^{\ominus}$ are an anion, $Z_1$, $Z_2$, $Z'_1$ and $Z'_2$ are each independently of one another hydrogen, $SO_3M$ or $PO_3M$, wherein M is hydrogen, alkali metal or ammonium, $t_1$ and $t_2$ are 1 or 0, when $t_1$ and $t_2$ are 0, $Z_1$, $Z_2$, $Z'_1$ and $Z'_2$ are hydrogen or one of $Z_1$, $Z_2$, $Z'_1$ and $Z'_2$ is hydrogen and the other is $SO_3M$ or $PO_3M$, $m_1$, $n_1$, $p_1$ and $q_1$ are integers, the sum of $(m_1+n_1)$ being 2 to 15 and that of $(p_1+q_1)$ being 25 to 200, and finishing the dyeing, irrespective of the depth of shade, in the pH range from 4.0 to 5.0.

The present invention is especially suitable for producing light to medium shades.

Preferred auxiliary combination components of formulae (1a) and (1b) are those in which the sum of $(m_1+n_1)$ is 5 to 12 and that of $(p_1+q_1)$ is 25 to 100.

The auxiliary combination may additionally comprise, as component (c), a nonionic compound of formula

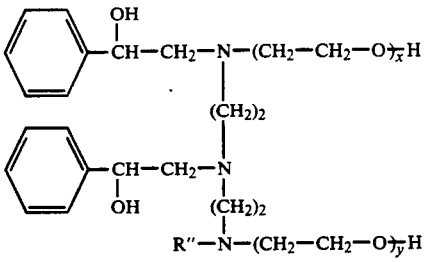

(2)

wherein R'' is an alkyl or alkenyl radical of 12 to 22 carbon atoms and x and y are integers, the sum of x and y being 80 to 140.

It is preferred to use auxiliary combinations comprising, as component (a), a compound of formula

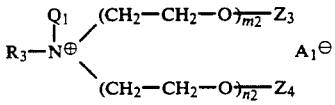

(3a)

and, as component (b), at least one compound of formula

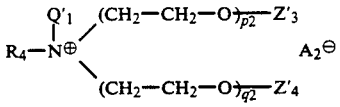

(3b)

and, as component (c), a compound of formula (2), wherein $R_3$ and $R_4$ are each independently of the other an aliphatic radical of 12 to 24 carbon atoms, $Q_1$ and $Q'_1$ are each independently of the other $C_1$-$C_4$alkyl or $—CH_2—CO—NH_2$, $Z_3$, $Z_4$, $Z'_3$ and $Z'_4$ are each independently of the other $SO_3M$, M is hydrogen, alkali metal or ammonium, $m_2$, $n_2$, $p_2$ and $q_2$ are integers, the sum of $(m_2+n_2)$ being 5 to 12 and that of $(p_2+q_2)$ being 25 to 100, and $A_1^{\ominus}$ and $A_2^{\ominus}$ are an anion.

A further preferred auxiliary combination comprises, as component (a), a compound of formula

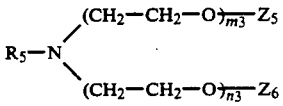

(4a)

and, as component (b), a compound of formula

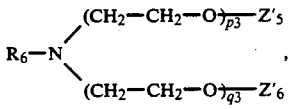

(4b)

wherein $R_5$ and $R_6$ are each independently of the other an aliphatic radical of 12 to 24 carbon atoms, $Z_5$ and $Z_6$ are hydrogen or one of $Z_5$ and $Z_6$ is hydrogen and the other is $SO_3M$, $Z'_5$ and $Z'_6$ are each independently of the other hydrogen or $SO_3M$, M is hydrogen, alkali metal or ammonium, and $m_3$, $n_3$, $p_3$ and $q_3$ are integers, the sum of $(m_3+n_3)$ being 5 to 12 and that of $(p_3+q_3)$ being 25 to 100.

Further preferred auxiliary combinations are those in which component (a) is a compound of formula (3a) and component (b) is a compound of formula (4b), or auxiliary combinations in which component (a) is a compound of formula (3b) and component (b) is a compound of formula (4a).

M in formulae (1), (3) and (4) is hydrogen, alkali metal such as sodium or potassium, and, preferably, ammonium. The radicals Q, Q', $Q_1$ and $Q'_1$ as well as $A^{\ominus}$, $A'^{\ominus}$, $A_1^{\ominus}$ and $A_2^{\ominus}$ in formulae (1) and (3) are derived from quaternising agents in which Q is $C_1$-$C_4$alkyl, $—CH_2—CO—NH_2$,

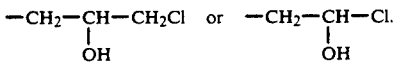

Illustrative examples of such quaternising agents are acetyl bromide, ethyl bromide, ethylene chlorohydrin, ethylene bromohydrin, epichlorohydrin, epibromohydrin, dimethyl sulfate, diethyl sulfate and, preferably, chloroacetamide.

Suitable aliphatic radicals $R_1$, $R_2$, $R_3$, $R_4$, $R_5$ and $R_6$ in formulae (1), (3) and (4) are alkyl or alkenyl radicals of 12 to 24, preferably 16 to 22, carbon atoms. Such radicals are typically n-dodecyl, myristyl, n-hexadecyl, n-heptadecyl, n-octadecyl, arachidyl, behenyl, dodecenyl, hexadecenyl, oleyl and octadecenyl.

The compounds of components (a), (b) and (c) are disclosed in U.S. Pat. No. 4,444,564.

The compounds of component (a) of formula (1a) are prepared by addition of 2 to 15 mol of ethylene oxide to aliphatic amines which contain an aliphatic radical of 12 to 24 carbon atoms, and in further optional steps, converting the adduct into the acid monoester and then the acid monester into the alkali or ammonium salt, or reacting the adduct with one of the above quaternising agents. The compounds of component (b) of formula (1b) are prepared by addition of 25 to 200 ml of ethylene oxide to aliphatic amines which contain an aliphatic radical of 12 to 24 carbon atoms, and in further optional steps, converting the adduct into the acid ester and then acid ester into the alkali or ammonium salt, or reacting the adduct with one of the above quaternising agents.

The compounds of formula (2) are prepared by addition of 80 to 140 mol of ethylene oxide to a compound of formula

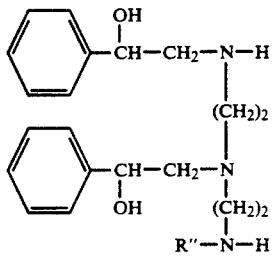

(5)

wherein R'' is as defined for formula (2).

The starting amines required for the preparation of the compounds of formulae (1), (3) and (4) may be saturated or unsaturated, branched or unbranched hydrocarbon radicals of 12 to 24, preferably 16 to 22, carbon atoms. The amines can be chemically homogeneous or are in the form of mixtures. Mixtures of amines are preferably those formed upon the conversion of natural fats or oils such as tallow oil, soybean oil or coconut oil into the corresponding amines. Specific amines are typically dodecylamine, hexadecylamine, octadecylamine, arachidylamine, behenylamine and octadecenylamine. A mixture of $C_{18}$-$C_{22}$fatty amines and tallow fatty amine is preferred. Tallow fatty amine is a mixture of ca. 30% of hexadecylamine, 25% of octadecylamine and 45% of octadecenylamine.

The addition of ethylene oxide as well as the esterification can be carried out by methods known per se. Esterification can be carried out with sulfuric acid or functional derivatives thereof such as chlorosulfonic acid and, preferably, sulfamic acid, The esterification is normally carried out by simple mixing of the reactants, with heating, conveniently to a temperature in the range from 50° to 100° C. The free acids can subsequently be converted into the alkali metal salts or ammonium salts by addition in conventional manner of a base such as ammonia, sodium hydroxide or potassium hydroxide.

In the process of this invention, the auxiliary combination used comprises 10 to 80 parts, preferably 20 to 70 parts, of component (a), 5 to 70 parts, preferably 5 to 50 parts, of component (b), and 0 to 70 parts, preferably 0 to 50 parts of the compound of component (c), and water to make up 100 parts.

The amounts in which the auxiliary combination comprising components (a), (b) and optionally (c) are added to the dyebath vary from 0.5 to 4 percent by weight, based on the material to be dyed. It is preferred to use 1 to 2 percent by weight of the auxiliary combination, based on the material.

The weight ratio of component (a) to component (b) is from 1:5 to 10:1, preferably from 1:2 to 5:1.

Suitable fibre material for dyeing by the process of this invention is wool. The material can be in a wide range of presentation, for example flocks, yarn, woven fabrics, knitted fabrics or carpets. The wool can have a normal or nonfelting finish.

Reactive dyes suitable for dyeing wool which has a normal or nonfelting finish by the process of this invention are the organic dyes known by this term-irrespective of the nature of their reactive groups.

This class of dyes is listed under "Reactive Dyes" in the Colour Index, 3rd Edition, 1971. They are predominantly dyes which contain at least one group which reacts with polyhydroxyl (cellulose) fibres or polyamide fibres, especially wool, a precursor of such a group, or a substituent which reacts with polyhydroxyl (cellulose) fibres or polyamide fibres.

Particularly suitable reactive dyes are those selected from the series of the monoazo, disazo or polyazo dyes, including the formazan dyes, as well as of the anthraquinone, xanthene, nitro, triphenylmethane, naphthoquinonimine, dioxazine and phthalocyanine dyes. The azo and phthalocyanine dyes can be metallised as well as non-metallised.

Illustrative examples of reactive groups and precursors which form such reactive groups are epoxy groups, the ethylenimide group, the vinyl group in vinylsulfone or in the acrylic acid radical, as well as the β-sulfatoethylsulfone group, the β-chloroethylsulfone group or the β-dialkylaminoethylsulfone group.

Reactive substituents of reactive dyes are those which are readily removable and leave behind an electrophilic radical.

Suitable substituents of this kind are typically 1 or 2 halogen atoms in an aliphatic acyl radical, for example in β-position or in α- and β-position of a propionyl radical, or in α-and/or β-position of an acrylic acid radical, or 1 or 3 halogen atoms on the following ring systems: pyridazine, pyrimidine, pyridazone, triazine, quinoxaline or phthalazine.

It is also possible to use dyes containing two or more identical or different reactive groups.

Preferred reactive dyes contain chloroacetyl, bromoacroyl or dibromopropionyl as reactive substituents.

The reactive dyes can contain acid salt-forming substituents such as carboxyl groups, sulfuric acid ester and phosphoric acid ester groups, phosphonic acid groups or, preferably, sulfo groups.

Preferred reactive dyes are those which contain at least one sulfo group, preferably reactive dyes of the azo or anthraquinone type which preferably contain two or three sulfo groups.

Mixtures of reactive dyes can also be used, in which case bichromatic and trichromatic dyeings can be produced.

Dyeing is carried out by the exhaust process. The amount of dye added to the dye liquor will depend on the desired colour strength. Amounts of 0.01 to 10 percent by weight, preferably 0.01 to 2 percent by weight, based on the weight of the fibre material, have generally been found useful.

The liquor ratio may be chosen within a wide range, typically from 1:3 to 1:100, preferably from 1:8 to 1:30.

The dyebaths may contain mineral acids such as sulfuric acid or phosphoric acid, organic aicds, preferably aliphatic carboxylic acids such as formic acid, acetic acid, oxalic acid or citric acid, and/or salts such as ammonium acetate, ammonium sulfate or sodium acetate. The acids are used in particular to adjust the pH of the liquor, which is in the range from 4 to 5.

The dye liquors may contain further ingredients, such as wool protective agents, dispersants amd wetting agents as well as antifoams.

The process of this invention does not require special apparatus. The conventional dyeing machines such as open baths and machines for dyeing slubbing, hanks or packages, jiggers, paddle dyeing machines, beam dyeing machines, circulating liquor or jet dyeing machines or winchbecks, can be used.

Dyeing is conveniently carried out in the temperature range from 60° to 120° C., preferably from 70° to 105° C. The dyeing time is within normal limits and is ordinarily from 20 to 120 minutes.

Upon completion of dyeing, the dyeing process may be followed by an aftertreatment with alkali, typically with aqueous ammonia, an alkali metal hydroxide, an alkali metal carbonate or hydrogencarbonate or hexamethylenetriamine. The pH of the alkali-containing dyebath is conveniently in the range from 7.5 to 9, preferably from 8 to 8.5.

Dyeing of the fibre material is conveniently carried out by briefly treating the goods with an aqueous liquor which contains the acid and the auxiliary combination comprising components (a) and (b) and optionally (c), and which has a temperature of 30°-60° C., and adding the reactive dye to the same bath. The temperature is then slowly raised so as to be able to dye in the temperature range from 80°-100° C. for 20 to 90 minutes, preferably for 30 to 60 minutes. The dyed goods are then treated, as required after the addition of alkali, preferably sodium hydrogencarbonate or sodium carbonate, for 10 to 20 minutes at 70°-90° C. Finally, the dyed material is removed from the bath and rinsed, acidified and dried in conventional manner.

The invention further relates to the auxiliary combination which comprises, as component (a), 10 to 80 parts of the compound of formula

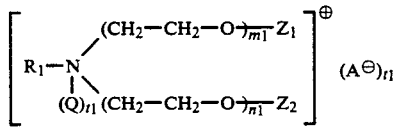

(1a)

as component (b), 5 to 70 parts of the compound of formula

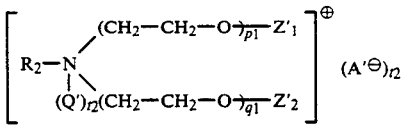

(1b)

wherein $R_1$ and $R_2$ are each independently of the other an aliphatic radical of 12 to 24 carbon atoms, Q and Q' are each independently of the other $C_1$-$C_4$alkyl, $—CH_2—CO—NH_2$,

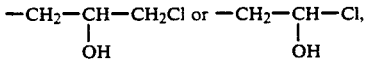

$A^{\ominus}$ and $A'^{\ominus}$ are an anion, $Z_1$, $Z_2$, $Z'_1$ and $Z'_2$ are each independently of one another hydrogen, $SO_3M$ or $PO_3M$, wherein M is hydrogen, alkali metal or ammonium, $t_1$ and $t_2$ are 1 or 0, when $t_1$ and $t_2$ are 0, $Z_1$, $Z_2$, $Z'_1$ and $Z'_2$ are hydrogen or one of $Z_1$, $Z_2$, $Z'_1$ and $Z'_2$ is hydrogen and the other is $SO_3M$ or $PO_3M$, $m_1$, $n_1$, $p_1$ and $q_1$ are integers, the sum of $(m_1+n_1)$ being 2 to 15 and that of $(p_1+q_1)$ being 25 to 200, and, as component (c), 0 to 70 parts of the compound of formula (2)

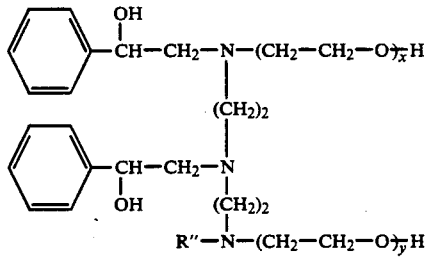

(2)

wherein R'' is an alkyl or alkenyl radical of 12 to 22 carbon atoms, and x and y are integers, the sum of x and y being 80 to 140.

The dyeing process of this invention gives non-skittery and level dyeings, especially in light to medium shades of good light- and wetfastness properties.

The invention is illustrated by the following Examples in which parts and percentages are by weight.

EXAMPLE 1

40 g of woollen fabric are treated for 10 minutes at 40° C. in a circulating liquor machine by the beam dyeing method. The liquor consists of 4 g of sodium sulfate sicc.
0.8 g of sodium acetate
2 g of 80% acetic acid
800 ml of water
0.4 g of the auxiliary combination $A_1$ consisting of
a) 50 parts of the polyadduct of 7 mol of ethylene oxide with 1 mol of tallow fatty amine, quaternised with chloroacetamide, and
b) 50 parts of the ammonium salt of the monosulfated polyadduct of 7 mol of ethylene oxide with 1 mol of tallow fatty amine, and
0.2 g of the auxiliary $B_2$ consisting of the polyadduct of 40 mol of ethylene oxide with 1 mol of a $C_{20}$–$C_{22}$ fatty amine.

The pH of the liquor is 4.5.

After addition of a solution which contains 12 mg of the dye of formula

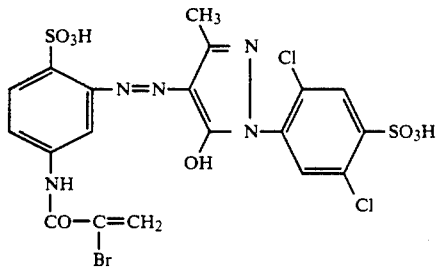

24 mg of the dye of formula

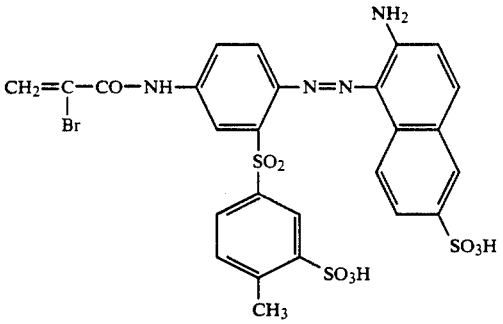

and 44 mg of the dye of formula

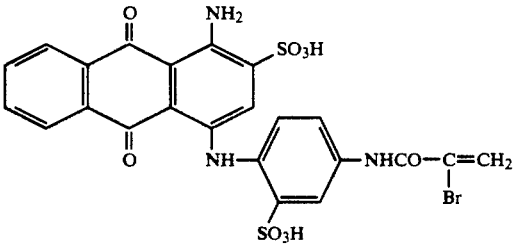

the dye liquor is kept for ca. 5 minutes at 40° C. and then heated to 60° C. at a rate of 1° C./min and kept at this temperature for 20 minutes. The liquor is then heated to 98° C. at a rate of 1° C./min and dyeing is carried out for 30 minutes. The liquor is cooled to 70° C. and the dyed goods are rinsed in conventional manner. A non-skittery and level dyeing of good fastness properties is obtained.

EXAMPLE 2

The procedure of Example 2 is repeated, using in place of the auxiliary $B_2$ 0.4 g of the auxiliary combination $B_1$ consisting of
a) 25.2 parts of the ammonium salt of the sulfated polyadduct of 8 mol of ethylene oxide with 1 mol of tallow fatty amine,
b) 21.3 parts of the polyadduct of 34 mol of ethylene oxide with 1 mole of a $C_{20-22}$fatty amine, quaternised with dimethyl sulfate, and
c) 7.0 parts of the compound of formula

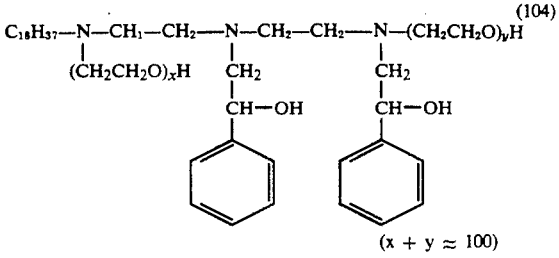

a non-skittery and level dyeing of good fastness properties is obtained.

EXAMPLE 3

The procedure described in Example 1 is repeated, using in place of the auxiliary $B_2$ 0.2 g of the polyadduct of 34 mol of ethylene oxide with 1 mol of a $C_{20-22}$fatty amine. A non-skittery and level dyeing of good fastness properties is obtained.

EXAMPLE 4

The procedure described in Example 1 is repeated, in place of the auxiliary $B_2$ 0.2 g of the quaternised polyadduct of 34 mol of ethylene oxide with 1 mol of a $C_{20-22}$-fatty amine. A non-skittery and level dyeing of good fastness properties is obtained.

EXAMPLE 5

The procedure described in Example 1 is repeated, using in place of the auxiliary $B_2$ 0.2 g of the polyadduct of 30 mol of ethylene oxide with 1 mol of tallow fatty amine. A non-skittery and level dyeing of good fastness properties is obtained.

EXAMPLE 6

1 kg of worsted spun yarn in cheese form is pretreated for 15 minutes in a circulating liquor machine with 9 l of water of 40° C., 100 g of sodium sulfate
9 g of ammonium acetate
37 ml of 80% acetic acid
9 g of a nonionic wetting agent based on 2-ethylhexanol
10 g of the auxiliary combination $A_1$
10 g of the auxiliary combination $B_1$ The pH of the liquor is 4.65. After addition of a solution which contains 0,3 g of the dye of formula (101), 0.6 g of the dye of formula (102) and 1.1 g of the dye of formula (103), the liquor is heated to 60° C. at a rate of 1°

C./min and kept at this temperature for 20 minutes. The liquor is then heated at a rate of 1° C./min and dyeing is carried out for 30 minutes. The liquor is cooled to 70° C. and the dyed goods are rinsed in conventional manner. If required, the fastness properties can be enhanced by an aftertreatment with alkali, for example with ammonia, sodium carbonate or sodium hydrogencarbonate. Non-skittery and level dyeings of excellent fastness properties are obtained.

EXAMPLE 7

The procedure described in Example 7 is repeated, using a dye solution comprising 4 g of the dye of formula (101)
6 g of the dye of formula (102), and
4 g of the dye of formula (103).

EXAMPLE 8

The procedure of Example 6 is repeated, using in place of the auxiliary combinations of $A_1$ and $B_1$ 30 g of the auxiliary combination $C_1$ of the following composition:

a) 5 parts of the polyadduct of 34 mol of ethylene oxide with 1 mol of a $C_{20-22}$fatty amine, quaternised with dimethyl sulfate, b) 2 parts of the compound of formula (104)
c) 20 parts of the polyadduct of 7 mol of ethylene oxide with 1 mol of tallow fatty amine, quaternised with chloroacetamide,
d) 20 parts of the ammonium salt of the monosulfated polyadduct of 7 mol of ethylene oxide with 1 mol of tallow fatty amine, and
e) 2 parts of the polyadduct of 80 mol of ethylene oxide with 1 mol of oleyl alcohol.

A non-skittery level dyeing of good fastness properties is obtained.

EXAMPLE 9

The procedure of Example 2 is repeated, using in place of the dye mixture 80 mg of the dye of formula

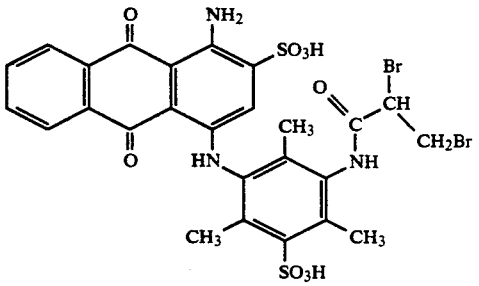

EXAMPLE 10

The procedure of Example 9 is repeated, using in place of 80 mg of the dye of formula (105) 80 mg of the dye of formula (106)

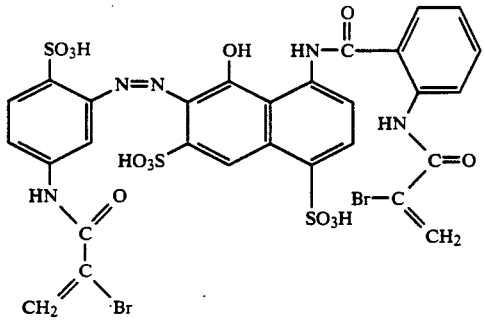

EXAMPLE 11

The procedure of Example 9 is repeated, using in place of 80 mg of the dye of formula (105) 200 mg of the dye of formula (107)

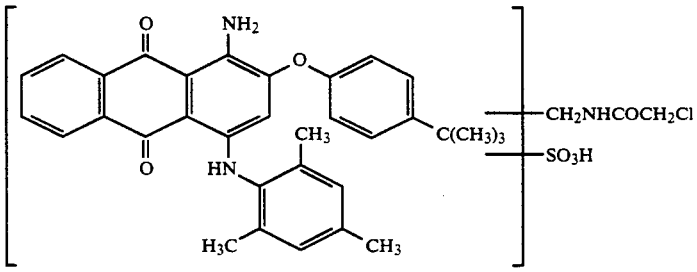

EXAMPLE 12

The procedure of Example 9 is repeated, using in place of 80 mg of the dye of formula (105) 320 mg of the dye of formula (108)

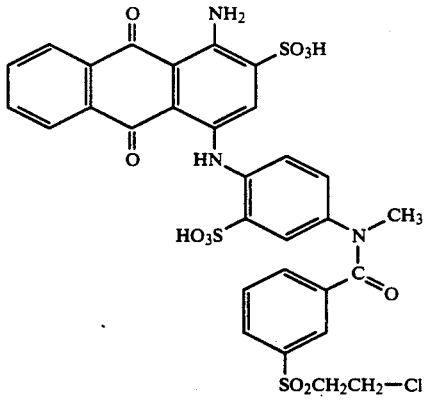

EXAMPLE 13

The procedure of Example 9 is repeated, using in place of 80 mg of the dye of formula (105) 100 mg of the dye of formula

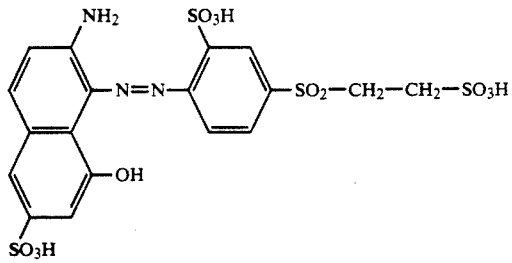

(109)

What is claimed is:

1. A process for producing non-skittery and level dyeings on wool with reactive dyes in the presence of an auxiliary combination, which process comprises dyeing wool with an aqueous liquor consisting of at least one reactive dye and an auxiliary combination comprising, as component (a), at least one compound of formula

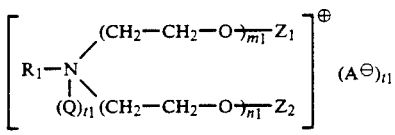

(1a)

and, as component (b), at least one compound of formula

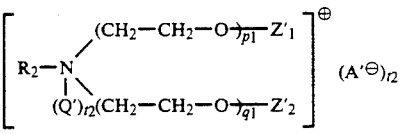

(1b)

wherein $R_1$ and $R_2$ are each independently of the other an alkyl or alkenyl radical of 12 to 24 carbon atoms, Q and Q' are each independently of the other $C_1$–$C_4$alkyl, $—CH_2—CO—NH_2$,

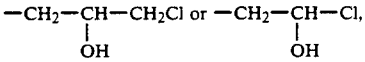

$A^{\ominus}$ and $A'^{\ominus}$ are an anion, $Z_1$, $Z_2$, $Z'_1$ and $Z'_2$ are each independently of one another hydrogen, $SO_3M$ or $PO_3M$, wherein M is hydrogen, alkali metal or ammonium, $t_1$ and $t_2$ are 1 or 0, when $t_1$ and $t_2$ are 0, $Z_1$, $Z_2$, $Z'_1$ and $Z'_2$ are hydrogen or one of $Z_1$, $Z_2$, $Z'_1$ and $Z'_2$ is hydrogen and the other is $SO_3M$ or $PO_3M$, $m_1$, $n_1$, $p_1$ and $q_1$ are integers, the sum of $(m_1+n_1)$ being 2 to 15 and that of $(p_1+q_1)$ being 25 to 200, and finishing the dyeing, irrespective of the depth of shade, in the pH range from 4.0 to 5.0.

2. A process according to claim 1, wherein the wool is dyed in light to medium shades.

3. A process according to claim 1, wherein the sum of $(m_1+n_1)$ is 5 to 12 and that of $(p_1+q_1)$ is 25 to 100.

4. A process according to claim 1, wherein the auxiliary combination additionally comprises, as component (c), a nonionic comound of formula

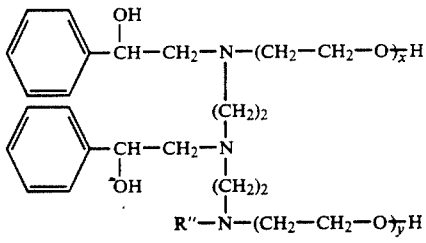

(2)

wherein R'' is an alkyl or alkenyl radical of 12 to 22 carbon atoms, and x and y are integers, the sum of x and y being 80 to 140.

5. A process according to claim 1, which comprises the use of an auxiliary combination wherein component (a) is a compound of formula

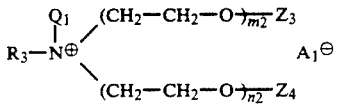

(3a)

and component (b) is a compound of formula

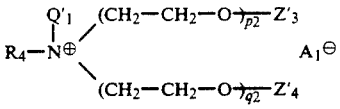

(3b)

and component (c) is a compound of formula (2), wherein $R_3$ and $R_4$ are each independently of the other an alkyl or alkenyl radical of 12 to 24 carbon atoms, $Q_1$ and $Q'_1$ are each independently of the other $C_1$ to $C_4$alkyl or $—CH_2—CO—NH_2$, $Z_3$, $Z_4$, $Z'_3$ and $Z'_4$ are each independently of the other $SO_3M$, M is hydrogen, alkali metal or ammonium, $m_2$, $n_2$, $p_2$ and $q_2$ are integers, the sum of $(m_2+n_2)$ being 5 to 12 and that of $(p_2+q_2)$ being 25 to 100, and $A_1^{\ominus}$ and $A_2^{\ominus}$ are an anion.

6. A process according to claim 1, which comprises the use of an auxiliary combination wherein component (a) is a compound of formula

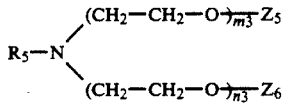

(4a)

and component (b) is a compound of formula

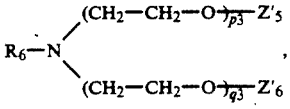

(4b)

wherein $R_5$ and $R_6$ are each independently of the other an alkyl or alkenyl radical of 12 to 24 carbon atoms, $Z_5$ and $Z_6$ are hydrogen or one of $Z_5$ and $Z_6$ is hydrogen and the other is $SO_3M$, $Z'_5$ and $Z'_6$ are each independently of the other hydrogen or $SO_3M$, M is hydrogen, alkali metal or ammonium, and $m_3$, $n_3$, $p_3$ and $q_3$ are integers, the sum of $(m_3+n_3)$ being 5 to 12 and that of $(p_3+q_3)$ being 25 to 100.

7. A process according to claim 1, which comprises the use of an auxiliary combination wherein component (a) is a compound of formula

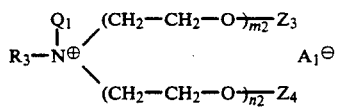

(3a)

and component (b) is a compound of formula

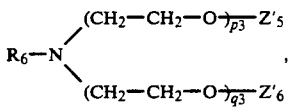

(4b)

wherein $R_3$ and $R_6$ are each independently of the other an alkyl or alkenyl radical of 12 to 24 carbon atoms, $Q_1$ is $C_1$ to $C_4$alkyl or $—CH_2—CO—NH_2$, $Z_3$, $Z_4$, are each independently of the other $SO_3M$, $Z'_5$ and $Z'_6$ are each independently of the other hydrogen or $SO_3M$, M is hydrogen, alkali metal or ammonium, $m_2$, $n_2$, $p_3$ and $q_3$ are integers, the sum of $(m_2+n_2)$ being 5 to 12, and that of $(p_3+q_3)$ being 25 to 100 and $A_1^{\ominus}$ is an anion.

8. A process according to claim 1, which comprises the use of an auxiliary combination wherein component (a) is a compound of formula

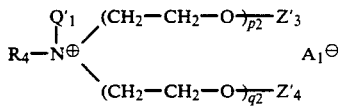

(3b)

and component (b) is a compound of formula

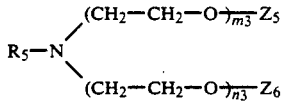

(4a)

wherein $R_4$ and and $R_5$ are each independently of the other an alkyl or alkenyl radical of 12 to 24 carbon atoms, $Q'_1$ is $C_1$ to $C_4$alkyl or $—CH_2—CO—NH_2$, $Z'_3$ and $Z'_4$ are each independently of the other $SO_3M$, $Z_5$ and $Z_6$ are hydrogen or one of $Z_5$ and $Z_6$ is hydrogen and the other is $SO_3M$, M is hydrogen, alkali metal or ammonium, $m_3$, $n_3$, $p_2$ and $q_2$ are integers, the sum of $(m_3+n_3)$ being 5 to 12 and that of $(p_2+q_2)$ being 25 to 100, and $A_2^{\ominus}$ is an anion.

9. A process according to claim 1, which comprises the use of an auxiliary combination consisting of 10 to 80 parts of component (a)

5 to 70 parts of component (b), and 0 to 70 parts of componente (c)

and water to make up 100 parts.

10. A process according to claim 1, wherein the weight ratio of component (a) to component (b) is from 1:5 to 10:1.

11. A process according to any one of claims 1, which comprises the use of reactive dyes which contain at least one sulfo group.

12. A process according to claim 11, which comprises the use of reactive dyes which contain chloroacetyl, bromoacetyl or dibromopropionyl.

13. A process according to claim 1, wherein dyeing is carried out in the temperature range from 60° to 120° C.

14. A process according to claim 1, wherein dyeing is carried out at a liquor ratio of 1:3 to 1:100, preferably from 1:8 to 1:30.

15. The auxiliary combination comprising, as component (a), 10 to 80 parts of the compound of formula

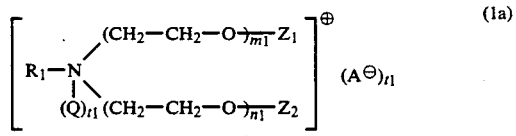

(1a)

as component (b), 5 to 70 parts of the compound of formula

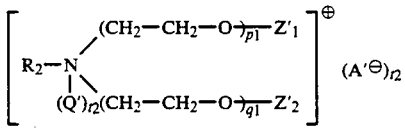

(1b)

wherein $R_1$ and $R_2$ are each independently of the other an alkyl or alkenyl radical of 12 to 24 carbon atoms, Q and Q' are each independently of the other $C_1$-$C_4$alkyl, $—CH_2—CO—NH_2$,

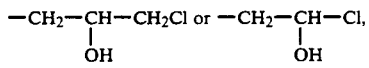

$A^{\ominus}$ and $A'^{\ominus}$ are an anion, $Z_1$, $Z_2$, $Z'_1$ and $Z'_2$ are each independently of one another hydrogen, $SO_3M$ or $PO_3M$, wherein M is hydrogen, alkali metal or ammonium, $t_1$ and $t_2$ are 1 or 0, when $t_1$ and $t_2$ are 0, $Z_1$, $Z_2$, $Z'_1$ and $Z'_2$ are hydrogen or one of $Z_1$, $Z_2$, $Z'_1$ and $Z'_2$ is hydrogen and the other is $SO_3M$ or $PO_3M$, $m_1$, $n_1$, $p_1$ and $q_1$ are integers, the sum of $(m_1+n_1)$ being 2 to 15 and that of $(p_1+q_1)$ being 25 to 200, and, as component (c), 0 to 70 parts of the compound of formula (2)

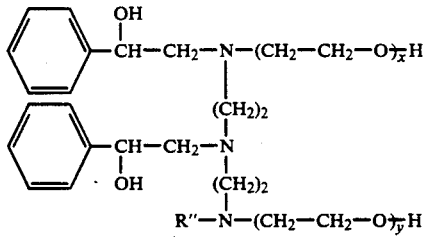

(2)

wherein R'' is an alkyl or alkenyl radical of 12 to 22 carbon atoms, and x and y are integers, the sum of x and y being 80 to 140.

16. The fibre material dyed by a process as claimed in claim 1.

* * * * *